US005154143A

United States Patent [19]

Stutzenberger

[11] Patent Number: 5,154,143

[45] Date of Patent: Oct. 13, 1992

[54] ELECTROHYDRAULIC VALVE CONTROL DEVICE FOR INTERNAL COMBUSTION ENGINES

[75] Inventor: Heinz Stutzenberger, Vaihingen/Enz, Fed. Rep. of Germany

[73] Assignee: Robert Bosch GmbH, Stuttgart, Fed. Rep. of Germany

[21] Appl. No.: 690,882

[22] PCT Filed: Oct. 26, 1990

[86] PCT No.: PCT/DE90/00818

§ 371 Date: Jun. 18, 1991

§ 102(e) Date: Jun. 18, 1991

[87] PCT Pub. No.: WO91/08383

PCT Pub. Date: Jun. 13, 1991

[30] Foreign Application Priority Data

Nov. 25, 1989 [DE] Fed. Rep. of Germany ..... 3939066

[51] Int. Cl.[5] ..... F01L 9/02; F01L 1/34

[52] U.S. Cl. ..... 123/90.12; 123/90.16

[58] Field of Search ..... 123/90.12, 90.13, 90.15, 123/90.16, 90.55, 90.57

[56] References Cited

U.S. PATENT DOCUMENTS 4,231,543 11/1980 Zurner et al. ..... 123/90.12
4,466,390 8/1984 Babitzka et al. ..... 123/90.12
4,671,221 6/1987 Geringer et al. ..... 123/90.12
4,674,451 6/1987 Rembold et al. ..... 123/90.12
4,696,265 9/1987 Nohira ..... 123/90.12
4,716,863 1/1988 Pruzan ..... 123/90.12
4,889,084 12/1989 Rembold ..... 123/90.12

FOREIGN PATENT DOCUMENTS 1023116 6/1983 U.S.S.R. ..... 123/90.12

*Primary Examiner*—E. Rollins Cross
*Assistant Examiner*—Weilun Lo
*Attorney, Agent, or Firm*—Edwin E. Greigg; Ronald E. Greigg

[57] ABSTRACT

An electrohydraulic valve control device for internal combustion engines in which a tappet volume for operating a valve piston arranged between an actuating cam operated cam piston and an engine valve can be reduced via a solenoid valve which is arranged in a drain passage. Arranged in this drain passage is a shut-off valve which is hydraulically actuated to open only when the valve piston has carried out a minimum stroke. This minimum stroke corresponds to a torque angle range of the camshaft in degrees of rotation during the opening actuation, in which, due to the shut-off valve, a control by the solenoid valve is not possible, whereby despite overlapping of engine valve opening times in a multicylinder engine, any overlapping of control times for the drain passages of individual engine valves, predetermined by the solenoid valve is prevented.

17 Claims, 2 Drawing Sheets

ELECTROHYDRAULIC VALVE CONTROL DEVICE FOR INTERNAL COMBUSTION ENGINES

STATE OF TECHNOLOGY

The invention is based on an electrohydraulic valve control device for internal combustion engines. In a known valve control device of this type, each individually controllable engine valve is assigned a solenoid valve so that in a multi-cylinder engine, there must be a number of solenoid valves which corresponds to the number of cylinders. This not only drives the costs of the entire control equipment, but it also raises the equipment's susceptibility to faults. For example, individual electrical wiring must be present between each solenoid valve and the electronic control unit, and the individual outlets for this wiring and solenoid valves must have a correspondingly elaborate switching and programming facility within the electronic control unit.

In a non-controllable engine valve, the opening stroke curve of the valve corresponds to the curve of the path of the actuating cam. The opening time cross-section is arranged so that it satisfies the maximum requirements, namely the full load at maximum number of revolutions. In the case of lower speeds, the torque and the performance of the internal combustion engine can be improved, as is known, when the closing instant of the engine inlet valve is arranged to occur earlier. Due to the lower number of revolutions and the reduced load, the required opening time cross-section will naturally also be reduced. For the shortening of the opening time cross-section, the drain passage is opened during the opening control action of the engine valve, as is known, by the solenoid valve, which is problematic in that a high opening control pressure exists at this instant in the pressure chamber, by which pressure, the solenoid valve is also pressurized. In order to be able to overcome this pressure, the solenoid valve must have either a pilot control or a strong opening magnet, in which a pilot control is time intensive, whereas a strong magnet is weight, volume, and cost intensive.

ADVANTAGES OF THE INVENTION

The electrohydraulic valve control device has an advantage that the high pressure chamber is separated in a simple way from the solenoid valve by the shut-off valve for the period during which, in any case, no control is intended to take place. In the special operating range for low loads and rotational speeds in particular, the solenoid valve can therefore control to open, as long as the shut-off valve is closed, so that as soon as the shut-off valve opens, the hydraulic oil can flow to the oil vessel via the solenoid valve, without pressure, and without loading the control unit of the solenoid valve. As soon as the actuating cam has completed its lift, and the cam piston is thus changing over from pressure stroke to suction stroke, the pressure in the pressure chamber drops sufficiently for the shut-off valve to close automatically. Any cavities remaining in the pressure chamber are filled up with control oil which flows in via the feed channel.

Due to the function related conditions, the solenoid valve can fortunately remain open at all times under low speeds and loads—the time cross-section is determined only by the first section of the actuating cam path, namely for as long as the valve piston, indirectly driven via the pressure chamber, actuates the control channel to open and thus opens the shut-off valve, whereupon the pressure in the pressure chamber is reduced and the engine valve closed again. With intermediate rotational speeds, the solenoid valve can then cycle the solenoid valve in tune with requirements, and under high speeds and loads, the solenoid valve remains shut at all times.

Naturally, the control of the shut-off valve requires tuning between pressures and closing forces of pressure chamber and shut-off valve, with the pressure in the pressure chamber being governed by the closing force of the engine valve and hence by its opening force.

In accordance with an advantageous refinement of the invention, a non-return valve which opens in the direction of the solenoid valve is arranged in the drain passage, between the shut-off valve and the solenoid valve, in which in accordance with a further refinement of the invention, further drain passages of other valve control units of the same internal combustion engine terminate in the drain passage between the non-return valve and solenoid valve. The invention provides the opportunity, mainly for multi-cylinder internal combustion engines, to control a number of engine valves with only one solenoid valve, even though there are overlaps between the opening actuating times of the individual engine valves. Since the shut-off valve cannot be actuated to open until after the engine valve has already opened a minimum distance, i.e. the actuating cam has been moved around by a minimum angle, the effect achieved is that the overlapping sections are functionally eliminated, i.e. that the control does not become effective until the torque angle range of the camshaft in which an overlap occurs is no longer effective. The non-return valve has in every case the effect that pressures which arise in the further drain passages, for example through opening pressures in pressure chambers of one of the other engine valves, do not extend into the pressure chamber of the engine valve concerned.

In accordance with a further advantageous refinement of the invention, a relief line exists between control channel and drain passage, upstream of the shut-off valve, in which a non-return valve which opens in the direction of the drain passage is arranged. Whenever the pressure in the pressure chamber has again been reduced and the control channel has again been shut off by the cam piston, the shut-off valve can force hydraulic oil for its closing action back to the pressure chamber via this relief line. During the opening control action, however, this non-return valve is kept blocked by the high pressure in the pressure chamber.

In accordance with a further advantageous refinement of the invention, the actuating cam has a cam path which for each torque angle rises gradually and drops abruptly. After a long, slow acceleration with an intermediate range of approximately constant stroke speed, a steep rundown occurs after a brief dwell in maximum opening position of the engine valve, by which—in particular after commencement of control—speedy closing of the engine valve is achieved.

In accordance with a further advantageous refinement of the invention, the shut-off valve is designed as a slide valve, the slide of which—movable against a closing spring—is pressurized at the front by hydraulic oil under pressure chamber pressure.

Further advantages and advantageous refinements of the invention can be found in the following description, drawing, and the claims.

DRAWING

An embodiment of the subject of the invention is presented in the drawing and described more closely hereafter.

DESCRIPTION OF THE EMBODIMENT

Figure 1:
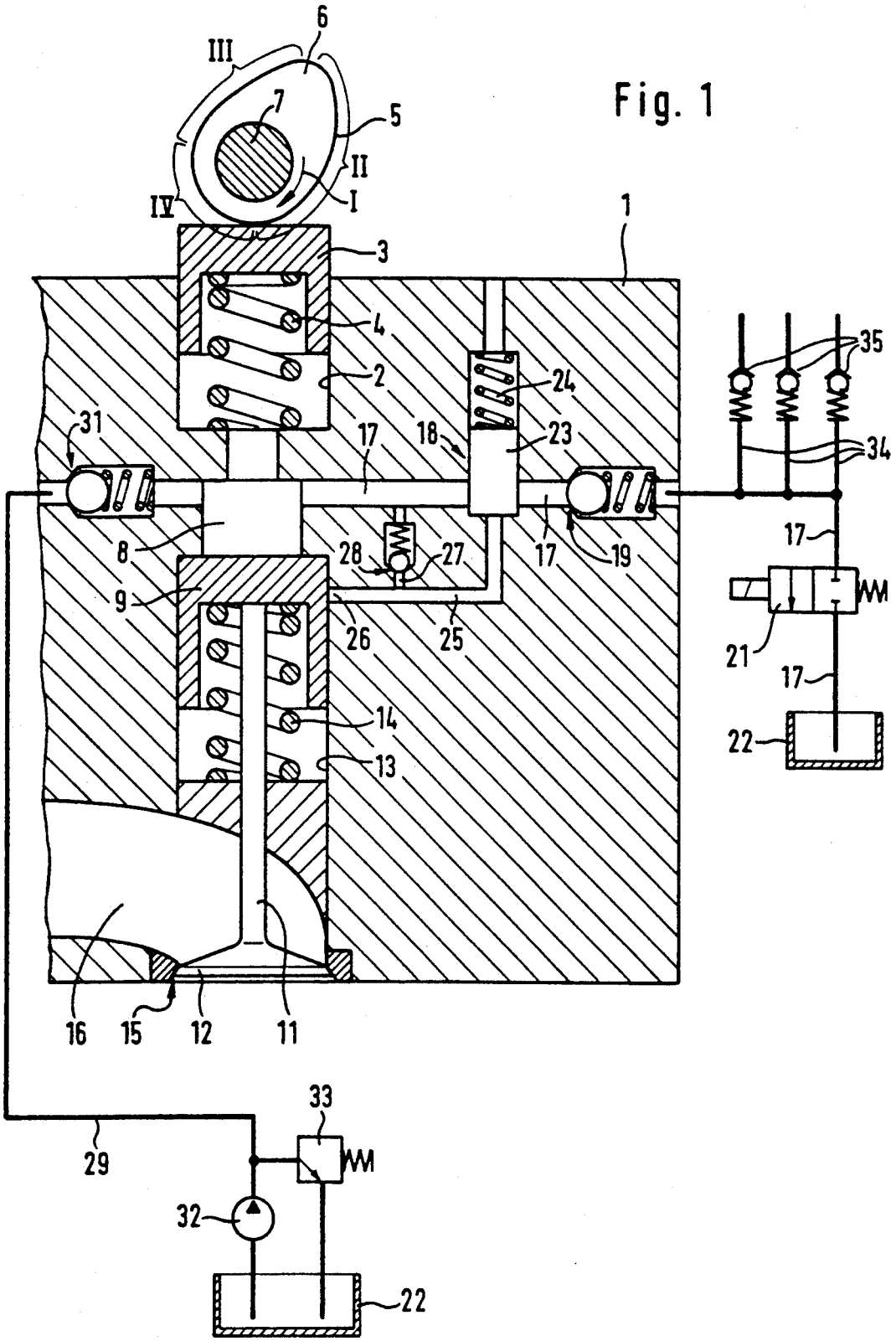
FIG. 1 shows a longitudinal section through a valve control device, in a much simplified presentation, with an associated hydraulic control diagram.

In the part of a cylinder head 1, shown in section in FIG. 1, a cam operated piston 3 is arranged in a bore 2, radially sealing and axially movable, which is pressed by a tappet spring 4 to the outer path 5 of an actuating cam 6 which is arranged on a camshaft 7, driven at half the number of engine revolutions synchronously with the crankshaft. The camshaft 7 is driven in the direction indicated by the arrow I and has a gradually rising pressure stroke section II, which is followed by a steep suction stroke section III in which the basic circle section IV of the cam path 5 takes effect between these two work sections II and III and for which path the cam piston remains in its starting position.

The cam piston 3 displaces hydraulic oil during the pressure stroke caused by the actuating cam 6 (pressure stroke section II of path 5), whereby it feeds hydraulic oil into a pressure chamber 8, driven against the force of the tappet spring 4.

The pressure chamber 8 is limited by a valve piston 9 which is connected with a valve stem 11 of a valve face 12 of an engine inlet valve. The valve piston 9 is supported axially movable and radially sealing in a bore 13 of the cylinder head 1 and is loaded by a closing spring 14 which presses the valve face 12 onto the valve seat 15 and determines the closing force of this engine inlet valve. In conjunction with the front face of the valve piston 9, which faces the pressure chamber, the working pressure is determined which develops during actuation of the cam piston 3 by the actuating cam 6 in the pressure chamber 8, before the valve piston 9, displaced by this working pressure, opens the engine valve and connects the induction port 16 with the combustion chamber of the internal combustion engine.

Branching off from the pressure chamber 8, which forms a hydraulic valve tappet with the cam piston 3 of the tappet spring 4 and the valve piston 9, is a drain passage 17, in which a shut-off valve 18, a non-return valve 19, and a solenoid valve 21 are arranged in flow direction, one after the other, before the drain passage 17 terminates in a hydraulic oil sump 22. The solenoid valve 21 is configured as a 2/2-way valve which closes without current. The non-return valve 19 opens in a flow direction towards the oil sump 22. The shut-off valve 18 is configured as a slide valve with a control slide 23 which is loaded by a control spring 24 in the shown direction of closing. The control slide 23 is actuated by a hydraulic pressure which pressurises the control slide 23 on the front face turned away from the control spring 24 and which is fed via a control channel 25, the entrance 26 of which is controlled by the valve piston 9. As soon as the valve piston 9 has covered a certain distance against the force of the closing spring 14, it moves, with its upper front edge, to open the aperature 26 of the control channel 25, so that the pressure from the pressure chamber 8 is transferred via the control channel 25 to the front face of the control slide 23, displacing the latter against the force of the control spring 24 whereupon the drain passage 17 is opened. Between the control channel 25 and the drain passage 17, there is a relief channel 27, in which a non-return valve 28 is arranged which opens in the direction of the drain passage 17.

Terminating in the pressure chamber 8 is a feed channel 29, in which a non-return valve 31 is arranged which opens in the direction of the pressure chamber. The feed channel 29 is supplied with hydraulic oil from the sump by a feed pump 32, the feed pressure of this pump 32 being largely maintained constant via a pressure holding valve 33.

In order to facilitate the control of several valve control units described above with the one solenoid valve 21, the drain passage 17 has drain passages 34 terminating in it, between the non-return valve 19 and the solenoid valve 21, with non-return valves 35 of other valve control units which are associated with the same engine. This embodiment concerns a four-cylinder internal combustion engine, in which the engine valve control units are always hydraulically decoupled from the solenoid valve 21 via the particular shut-off valve 18, in which the actuating cam 6 happens be ineffective at that time.

The described electrohydraulic valve control device operates as follows: The actuating cam 6 is driven in the direction I via the camshaft 7 which is driven synchronously with the crankshaft at half the number of engine revolutions, during which operation it actuates the cam piston 3, via its cam path II to IV, against the force of the tappet spring 4, with hydraulic oil present in bore 2 being fed into pressure chamber 8 during the pressure stroke section II of the path 5, subsequently—during the suction stroke section III of path 5—drawing oil again from the pressure chamber 8 in the suction stroke of the cam piston 3. During the cam section IV which corresponds to the basic circuit of the actuating cam, the cam piston 3 remains in the shown position, with the tappet spring 4 ensuring positive contact between cam piston 3 and the actuating cam path. The tappet spring 4 does not, however, have any effect on the pressure in the pressure chamber 8.

Due to the feed of the cam piston 3, the valve piston 9, including valve stem 11 and valve face 12, is moved downwards against the force of the closing spring 14, as a result of which the valve face 12 lifts off its valve seat 15 and the induction port 16 is accordingly opened. The amount of air which then flows into the engine cylinder depends, on the one hand, on this opening stroke and, on the other hand, on the duration of opening, resulting in the so-called opening time cross-section. So long as no hydraulic oil can flow from the pressure chamber 8, this opening time cross-section is inversely proportional to the number of revolutions, i.e. with high revolutions, the opening time cross-section is small, with lower numbers of revolutions it is large. Added to this are influences due to inertia of masses, friction, and throttle effects, which will not, however, be dealt with here in any detail. During this feed phase of the cam piston 3, the non-return valve 31 and hence the supply channel 29 are blocked. Initially, the drain passage 17 is also blocked by the shut-off valve 18. As soon as the valve piston 9 is displaced by a minimum distance, it actuates the entrance 26 of the control channel 25 to open, whereupon the oil pressure progresses to the front face of the control slide 23, moving it against the force of the control spring 24, whereby the drain passage 17 is opened. So long as the solenoid valve 21 is blocked, the control action to open the shut-off valve 18 will not have any substantial effect on the pressure in the pressure chamber 8, so that the valve piston 9 and hence the valve face 12 are moved further downwards, as long as the pressure stroke section II of the actuating cam 6 is effective. This pressure stroke section II is designed so that the stroke movement is largely linear, i.e. uniformly carried out, with a smooth transition towards the stroke end.

When the suction stroke section III of the actuating cam 6 becomes effective, which is relatively steep, the cam piston 3 will again arrive in its starting position at only about 60° to 80° torque angle of the camshaft—driven by the tappet spring 4—so that the valve piston 9 and the valve face 12 are also driven upwards correspondingly fast, after which the engine valve will close. In this process, the entrance 26 of the control channel 25 is blocked by the valve piston 9, but previous to that and occasioned by the pressure reduction in the pressure chamber 8, the control slide—driven by the control spring 24—is moved in the direction of its blocking position. In every case, the relief line 27 allows residual oil volumes, which have been displaced by the control slide 23, to flow back via the non-return valve 28 into the drain passage 17 and ensure the blocking position of the shut-off valve 18.

If due to the flow-off of oil, a vacuum arises in the pressure chamber 8, this is balanced out via the feed channel 29, supplying fluid from the feed pump 32, with the hydraulic oil flowing in via the non-return valve 31 and creating a constant filling pressure in accordance with the supply pressure of the pressure holding valve 33 in the pressure chamber 8 for the shown starting position, in which the basic circuit section IV of the actuating cam 6 is effective.

If however the solenoid valve 21 is open at the working stroke of the actuating cam 6, hydraulic oil will flow, after the shut-off valve 18 has been opened following the predetermined pilot stroke of the valve piston 9, from the pressure chamber 8 via this drain passage 17, the non-return valve 19, and the solenoid valve 21, into the oil sump 22. During this supply process, this feed pressure of the control slides 23 is held in the opening actuating position, assuming again the shown starting position, as described above, with the commencement of the suction stroke of the cam piston 3.

Figure 2:
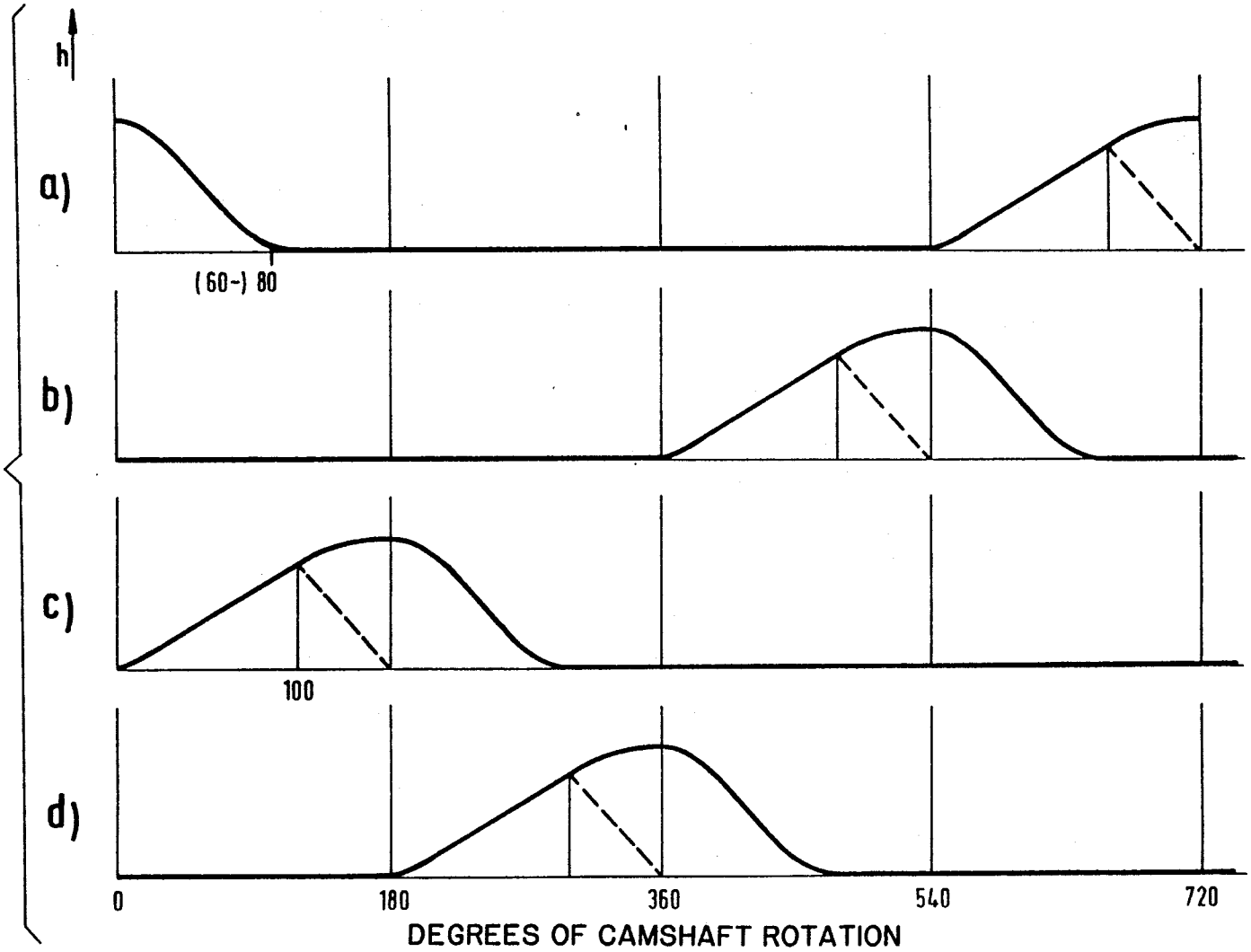
FIGS. 2 (*a–d*) shows a function diagram or four identical valve control devices for a four-cylinder internal combustion engine.

Supported by the diagram in FIGS. 2(*a–d*) the function of the engine valve control according to the invention, applicable to a four-cylinder internal combustion engine is described, with the drain passages 34 leading to the other three engine valve control units and with all four engine valve control units of ,this engine being controlled via only one solenoid valve 21. In FIG. 2, the stroke h (ordinate) of the valve piston 9 or the valve face 12 is shown above the torque angle in degrees of rotation of the cam shaft (abscissa). The four engine cylinders are described with a, b, c, and d, in the sequence of their arrangement next to one another. The firing sequence of this four-cylinder internal combustion engine is c, d, b, a. As will be seen from the curves shown in the four diagrams arranged one on top of another, they have a slow start—corresponding to the path 5 of the actuating cam 6—with approximately constant stroke variation and a steep drop, always approximately at 180° camshaft opening stroke and 60° to 80° camshaft closing stroke.

The diagram for cylinder c in FIG. 2*c* shows that, when at 100° camshaft and a corresponding stroke of the valve piston 9, the shut-off valve 18 and also the drain passage 17 are actuated to open, the closing instant of the engine valve, i.e. the seating of the valve face 12 in its seat 15, as shown by the dotted line, is reached at 180° camshaft. This means that when the solenoid valve 21 is open, the opening stroke of the engine valve is ended at approximately 100° camshaft, so that it will have closed at approximately 180° camshaft. No closing control can thus occur until 100° camshaft, since the shut-off valve 18 is always closed until then. It will be seen from the diagram relating to the cylinder a of the internal combustion engine FIG. 2*a*, that the closing action of the engine valve is completed at 60° to 80° camshaft, even if the suction stroke of the cam piston 3 has commenced at 0° camshaft. This in turn means that with overlapping opening times of the individual engine valves, such as is the case for the engine cylinders a and c, an actuation to open the drain passage of the valve control unit for cylinder 'a' cannot have any control influence on the valve control unit of the cylinder 'c', since at 'c', the drain passage 17 is still blocked by the shut-off valve 18, to be opened only at approximately 100° camshaft. With only one solenoid valve 21, it is thereby possible to control all valve control units of the 4-cylinder engine, since, regarding the control time of one of these control units, there can be no overlap with that of one of the other control units.

The actuation of the solenoid valve 21 effected by the electronic control unit can therefore be such that this solenoid valve remains closed at high revolutions and at high load, in order to achieve an optimum opening time cross-section on the engine valve, and that the solenoid valve will always remain open at low revolution and low loads in order to keep the opening time cross-section as small as possible, this then being determined by the blocking time of the shut-off valve. In the intermediate speed and load range, i.e. in the range of revolutions between the opening instant of the shut-off valve 18 and the control situation in which the solenoid valve 21 is always blocked, control is effected by timing of the solenoid valve which may be, for example, synchronous with the crank angle. In this way, the range between 100° camshaft and 270° camshaft, i.e. the final valve closing point, is controlled via the solenoid valve 21, separately for each of the four cylinders.

All features presented in the description, the following claims, and the drawing can be significant to the invention both in isolation and in any combination with each other.

I claim:

1. An electrohydraulic valve control device for internal combustion engines which comprise an actuating cam of an engine camshaft, an engine valve including a valve stem axially actuated via a valve tappet, by the actuating cam of the engine camshaft, a variable volume pressure chamber, filled with hydraulic oil, which determines an effective length of the valve tappet, this chamber being limited by a cam piston, which is actuated by said actuating cam, and by a valve piston which acts on the valve stem, a drain passage for the hydraulic oil which branches off from the pressure chamber, a hydraulic oil feed channel that contains a non-return valve which opens towards the pressure chamber and which terminates in the pressure chamber, a solenoid valve (21) driven by an electronic control unit which processes engine characteristics for the control of the drain passage and hence of the pressure chamber volume, said drain passage (17) is blocked via a shut-off valve (18) which is arranged to open by hydraulic control pressure, said valve piston (9), after executing a stroke which corresponds to a particular torque range (° camshaft) of the camshaft (7), actuates to open a control channel (25), and the control channel (25) leads to the shut-off valve (18) for the transmission of the pressure chamber pressure as the control pressure on the shut-off valve, so that after the control channel (25) has been actuated to open by the valve piston (9), the shut-off valve (18) is opened by the working pressure in the pressure chamber (8).

2. A valve control device in accordance with claim 1, in which a non-return valve (19) which opens in the direction of the solenoid valve (21) is arranged in the drain passage (17) between the shut-off valve (18) and the solenoid valve (21).

3. A valve control device in accordance with claim 2, in which drain channels (34) of other valve control units of the same internal combustion engine terminate in the drain passage (17) between the non-return valve (19) and the solenoid valve (21).

4. A valve control device in accordance with claim 1, in which a relief line (27) exists between the control channel (25) and the drain passage (17) upstream of the shut-off valve (18), in which the relief line a non-return valve (28) is arranged which opens toward the drain passage (17).

5. A valve control device in accordance with claim 2, in which a relief line (27) exists between the control channel (25) and the drain passage (17) upstream of the shut-off valve (18), in which the relief line a non-return valve (28) is arranged which opens toward the drain passage (17).

6. A valve control device in accordance with claim 3, in which a relief line (27) exists between the control channel (25) and the drain passage (17) upstream of the shut-off valve (18), in which the relief line a non-return valve (28) is arranged which opens toward the drain passage (17).

7. A valve control device in accordance with claim 1, in which the actuating cam (6) has a path (5) (II to IV) which rises slowly for the feed stroke of the cam piston (3) to be actuated (pressure stroke section II) and drops steeply for the suction stroke (suction stroke section III).

8. A valve control device in accordance with claim 2, in which the actuating cam (6) has a path (5) (II to IV) which rises slowly for the feed stroke of the cam piston (3) to be actuated (pressure stroke section II) and drops steeply for the suction stroke (suction stroke section III).

9. A valve control device in accordance with claim 3, in which the actuating cam (6) has a path (5) (II to IV) which rises slowly for the feed stroke of the cam piston (3) to be actuated (pressure stroke section II) and drops steeply for the suction stroke (suction stroke section III).

10. A valve control device in accordance with claim 4, in which the actuating cam (6) has a path (5) (II to IV) which rises slowly for the feed stroke of the cam piston (3) to be actuated (pressure stroke section II) and drops steeply for the suction stroke (suction stroke section III).

11. A valve control device in accordance with claim 5, in which the actuating cam (6) has a path (5) (II to IV) which rises slowly for the feed stroke of the cam piston (3) to be actuated (pressure stroke section II) and drops steeply for the suction stroke (suction stroke section III).

12. A valve control device in accordance with claim 6, in which the actuating cam (6) has a path (5) (II to IV) which rises slowly for the feed stroke of the cam piston (3) to be actuated (pressure stroke section II) and drops steeply for the suction stroke (suction stroke section III).

13. A valve control device in accordance with claim 1, in which the shut-off valve (18) is designed as a slide valve, the slide (23) is movable from its blocking position against a return spring (24) by hydraulic oil which is fed through the control channel (25) when pressurized on a front face, which is turned away from the return spring (24).

14. A valve control device in accordance with claim 2, in which the shut-off valve (18) is designed as a slide valve the slide (23) is movable form its blocking position against a return spring (24) by hydraulic oil which is fed through the control channel (25) when pressurized on a front face, which is turned away from the return spring (24).

15. A valve control device in accordance with claim 3, in which the shut-off valve (18) is designed as a slide valve, the slide (23) is movable form its blocking position against a return spring (24) by hydraulic oil which is fed through the control channel (25) when pressurized on a front face, which is turned away from the return spring (24).

16. A valve control device in accordance with claim 4, in which the shut-off valve (18) is designed as a slide valve, the slide (23) is movable from its blocking position against a return spring (24) by hydraulic oil which is fed through the control channel (25) when pressurized on a front face, which is turned away from the return spring (24).

17. A valve control device in accordance with claim 7, in which the shut-off valve (18) is designed as a slide valve, the slide (23) is movable from its blocking position against a return spring (24) by hydraulic oil which is fed through the control channel (25) when pressurized on a front face, which is turned away from the return spring (24).

* * * * *